US008971748B2

(12) United States Patent
Nakamura

(10) Patent No.: US 8,971,748 B2
(45) Date of Patent: Mar. 3, 2015

(54) IMAGE FORMING APPARATUS

(71) Applicant: Konica Minolta, Inc., Tokyo (JP)

(72) Inventor: Masakazu Nakamura, Hachioji (JP)

(73) Assignee: Konica Minolta, Inc. (JP)

( * ) Notice: Subject to any disclaimer, the term of this patent is extended or adjusted under 35 U.S.C. 154(b) by 0 days.

(21) Appl. No.: 14/134,808

(22) Filed: Dec. 19, 2013

(65) Prior Publication Data

US 2014/0178090 A1 Jun. 26, 2014

(30) Foreign Application Priority Data

Dec. 21, 2012 (JP) ..... 2012-280133

(51) Int. Cl.
*G03G 15/00* (2006.01)
*G03G 15/16* (2006.01)

(52) U.S. Cl.
CPC ..... *G03G 15/161* (2013.01); *G03G 15/1615* (2013.01); *G03G 2215/00143* (2013.01); *G03G 2215/00156* (2013.01); *G03G 2215/1661* (2013.01)
USPC ..... 399/71; 399/101

(58) Field of Classification Search
CPC ..... G03G 2215/00143; G03G 2215/00156
USPC ..... 399/71, 101
See application file for complete search history.

(56) References Cited

U.S. PATENT DOCUMENTS

| | | | | |
|---|---|---|---|---|
| 5,896,979 | A * | 4/1999 | Hokari et al. | 198/807 |
| 6,321,052 | B1 * | 11/2001 | Yamashina et al. | 399/165 |
| 2004/0091276 | A1 | 5/2004 | Yoshida et al. | |
| 2004/0265023 | A1 | 12/2004 | Yoshida et al. | |
| 2013/0016996 | A1 * | 1/2013 | Yuasa | 399/121 |

FOREIGN PATENT DOCUMENTS

| | | | |
|---|---|---|---|
| JP | 2004-157532 | A | 6/2004 |
| JP | 2005-77579 | A | 3/2005 |

* cited by examiner

*Primary Examiner* — David Gray
*Assistant Examiner* — Tyler Hardman
(74) *Attorney, Agent, or Firm* — Cantor Colburn LLP

(57) ABSTRACT

An image forming apparatus includes an endless belt, a steering mechanism adapted to correct deviation of the belt, a cleaning blade adapted to abut the belt so as to clean the belt, a timer adapted to clock the time necessary for the steering mechanism to correct the deviation of the belt, an adjuster adapted to adjust the abutting state between the belt and the cleaning blade by making the amount of toner supplied to the belt larger than a predetermined amount, and a controller adapted to control the operation of the adjuster. The controller controls the operation of the adjuster based on the time clocked by the timer.

7 Claims, 7 Drawing Sheets

IMAGE FORMING APPARATUS

CROSS REFERENCES TO RELATED APPLICATIONS

The present invention contains subject matter related to Japanese Patent Application JP 2012-280133 filed in the Japanese Patent Office on Dec. 21, 2012, the entire contents of which being incorporated herein by reference.

BACKGROUND OF THE INVENTION

1. Field of the Invention

The present invention relates to an electrophotographic image forming apparatus.

2. Description of the Related Art

Conventionally, there has been known an image forming apparatus having an endless belt as an intermediate transfer body or a conveying belt. Examples of such image forming apparatus include the one which has a cleaner adapted to remove toner and/or the like remaining on the belt. As an example of such cleaner, there is known a cleaner having a cleaning blade which has elasticity and whose end portion abuts the belt so as to remove the toner from the belt.

The problem with the image forming apparatus having such a cleaning blade is that blade burr will be caused due to the deformation of the cleaning blade in the rotating direction of the belt. To solve such a problem, there is proposed an image forming apparatus in which a measure is implemented to prevent the blade burr from being formed.

For example, Japanese Unexamined Patent Application Publication No. 2004-157532 describes an image forming apparatus in which if the cleaning blade and the like are new, or if the temperature and humidity inside or outside the apparatus meet a predetermined condition, a lubricant will be coated onto the belt.

Further, Japanese Unexamined Patent Application Publication No. 2005-77579 describes an image forming apparatus in which if the temperature detected by a temperature detector is equal to or higher than a predetermined value, image forming operation will be stopped.

SUMMARY OF THE INVENTION

However, in the image forming apparatus described in Japanese Unexamined Patent Application Publication No. 2004-157532, if the cleaning blade and the like are new, or if the temperature and humidity inside or outside the apparatus meet a predetermined condition, the lubricant will be coated onto the belt even if the possibility of occurrence of the blade burr is actually low.

Further, in the image forming apparatus described in Japanese Unexamined Patent Application Publication No. 2005-77579, if the temperature detected by the temperature detector is equal to or higher than a predetermined temperature, the image forming operation will be stopped even if the possibility of occurrence of the blade burr is actually low.

In other words, in the image forming apparatuses described in Japanese Unexamined Patent Application Publication No. 2004-157532 and Japanese Unexamined Patent Application Publication No. 2005-77579, the measure for preventing blade burr will be implemented upon detecting an environment under which the blade is susceptible to burr, even in the case where such measure is actually not necessary to be implemented.

In view of the aforesaid problems, it is an object of the present invention to provide an image forming apparatus capable of implementing the measure for preventing blade burr at appropriate time.

To solve the aforesaid problems, an image forming apparatus according to an aspect of the present invention includes a belt, a steering mechanism, a cleaning blade, a timer, an adjuster and a controller.

The belt is an endless belt, the steering mechanism is adapted to correct deviation of the belt, the cleaning blade is adapted to abut the belt so as to clean the belt, the timer is adapted to clock the time necessary for the steering mechanism to correct the deviation of the belt, the adjuster is adapted to adjust the abutting state between the belt and the cleaning blade, and the controller is adapted to control the operation of the adjuster based on the time clocked by the timer.

DETAILED DESCRIPTION OF THE PREFERRED EMBODIMENT

Figure 1:
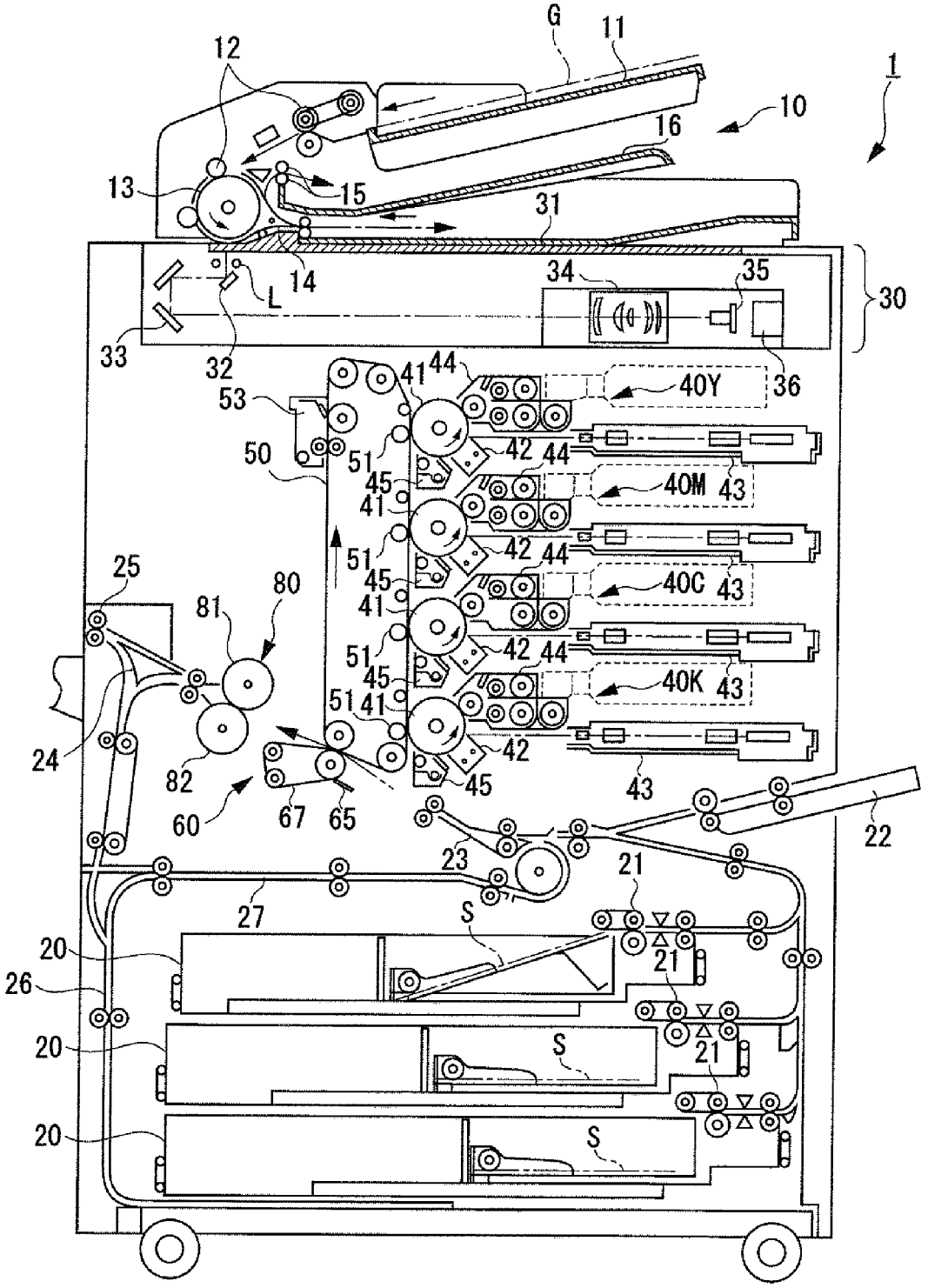
FIG. 1 is a cross-sectional view schematically showing an image forming apparatus according to an embodiment of the present invention.

An image forming apparatus 1 according to an embodiment of the present invention will be described below with reference to FIGS. 1 to 8. Note that, in FIGS. 1 to 8, like components are denoted by like reference numerals.

[Configuration Example of Image Forming Apparatus]

First, the image forming apparatus 1 will be briefly described below with reference to FIG. 1.

FIG. 1 is a cross-sectional view schematically showing the image forming apparatus 1 according to the embodiment of the present invention.

As shown in FIG. 1, the image forming apparatus 1 is adapted to form an image on a sheet based on electrophotographic technology. The image forming apparatus 1 is a tandem type color image forming apparatus, in which four colors of toner, which are yellow (Y), magenta (M), cyan (C), and black (Bk), are superimposed one on top of another. The image forming apparatus 1 includes a document conveying section 10, a plurality of sheet accommodating sections 20, an image reading section 30, an image forming section 40, an intermediate transfer belt 50, a secondary transfer section 60, and a fixing section 80.

The document conveying section 10 includes a document feeding table 11 on which a document G is set, a plurality of rollers 12, a conveying drum 13, a conveying guide 14, a document ejecting roller 15, and a document receiving tray 16. The document G set on the document feeding table 11 is conveyed page by page to a reading position of the image reading section 30 by the plurality of rollers 12 and the conveying drum 13. The conveying guide 14 and the document ejecting roller 15 eject the document G conveyed by the plurality of rollers 12 and the conveying drum 13 to the document receiving tray 16.

The image reading section 30 reads the image of the document G conveyed by the document conveying section 10 or the image of a document placed on a platen 31, and creates image data. To be specific, the image of the document G is irradiated by a lamp L. The light reflected from the document G is guided to a first mirror unit 32, a second mirror unit 33 and a lens unit 34 in that order, so as to form an image on a light receiving surface of an image pickup device 35. The image pickup device 35 photoelectrically converts the light incident thereon and outputs a prescribed image signal. The image signal outputted by the image pickup device 35 is A/D converted to thereby create image data.

The image reading section 30 has an image reading control section 36. The image reading control section 36 performs various processing, such as shading correction, dither processing, compression and/or the like, on the image data created by the A/D conversion, and stores the resultant data in a RAM 103 of a controller 100 (see FIG. 4). Incidentally, the image data is not limited to the data outputted from the image reading section 30, but may also be data received from an external device (such as a personal computer, another image forming apparatus or the like) connected to the image forming apparatus 1.

The plurality of sheet accommodating sections 20 are arranged in the lower portion of the main body of the apparatus, and the number of the sheet accommodating sections 20 is determined according to the sizes and/or kinds of sheets. The sheet is fed by a sheet feeding section 21 and conveyed to a conveying section 23, and is then conveyed to the secondary transfer section 60 (which is the transfer position) by the conveying section 23. Further, a manual sheet feeding section 22 is arranged in the vicinity of the sheet accommodating sections 20. A specialty sheet, such as a sheet of a size not accommodated in the sheet accommodation section 20, a tag sheet having a tag, an OHP sheet or the like, is sent to the transfer position from the manual sheet feeding section 22.

The image forming section 40 (as an adjuster of the present embodiment) and the intermediate transfer belt 50 are arranged between the image reading section 30 and the sheet accommodating section 20. The image forming section 40 has four image forming units 40Y, 40M, 40C, 40K for forming a toner image of yellow (Y), a toner image of magenta (M), a toner image of cyan (C), and a toner image of black (K).

To be specific, the first image forming unit 40Y forms a toner image of yellow, the second image forming unit 40M forms a toner image of magenta, the third image forming unit 40C forms a toner image of cyan, and the fourth image forming unit 40K forms a toner image of black. Since the four image forming units 40Y, 40M, 40C, 40K have the same configuration, only the first image forming unit 40Y will be described herein.

The first image forming unit 40Y has a drum-like photoreceptor 41, a charging section 42 arranged around the photoreceptor 41, an exposure section 43, a developing section 44, and a cleaning section 45. The photoreceptor 41 is rotated by a drive motor (not shown). The charging section 42 applies electric charges to the photoreceptor 41 so that the surface of the photoreceptor 41 is evenly charged. The exposure section 43 performs an exposure operation on the surface of the photoreceptor 41 based on the image data read from the document G or the image data transmitted from the external device, to thereby form an electrostatic latent image on the photoreceptor 41.

The developing section 44 causes yellow toner to adhere to the electrostatic latent image formed on the photoreceptor 41. Thus, a toner image of yellow is formed on the surface of the photoreceptor 41. Incidentally, the developing section 44 of the second image forming unit 40M causes the magenta toner to adhere to the photoreceptor 41 of the second image forming unit 40M, the developing section 44 of the third image forming unit 40C causes the cyan toner to adhere to the photoreceptor 41 of the third image forming unit 40C, and the developing section 44 of the fourth image forming unit 40K causes the black toner to adhere to the photoreceptor 41 of the fourth image forming unit 40K.

The cleaning section 45 removes the toner remaining on the surface of the photoreceptor 41.

The toner adhering to the photoreceptor 41 is transferred to the intermediate transfer belt 50 (which is an example of an intermediate transfer body). The intermediate transfer belt 50 is an endless belt wrapped around a plurality of rollers. The intermediate transfer belt 50 is driven by a drive motor (not shown) to rotate in a direction opposite to the rotation (moving) direction of the photoreceptor 41.

In the intermediate transfer belt 50, four primary transfer sections 51 are arranged in positions facing the respective photoreceptors 41 of the four image forming units 40Y, 40M, 40C, 40K. Each primary transfer section 51 applies a voltage having a polarity opposite to that of toner to the intermediate transfer belt 50, to thereby transfer the toner adhering on the photoreceptor 41 to the intermediate transfer belt 50.

Thus, by rotationally driving the intermediate transfer belt 50, four toner images respectively formed by the four image forming units 40Y, 40M, 40C, 40K are sequentially transferred to the surface of intermediate transfer belt 50. Consequently, a toner image of yellow, a toner image of magenta, a toner image of cyan, and a toner image of black are superimposed on the intermediate transfer belt 50 to thereby form a color image.

Further, a belt cleaning device 53 faces the intermediate transfer belt 50. The belt cleaning device 53 is adapted to clean the surface of the intermediate transfer belt 50, which has completed the transfer of the toner image to the sheet.

The secondary transfer section 60 is arranged near the intermediate transfer belt 50 and on the downstream side of the conveying section 23 in the sheet conveying direction. The secondary transfer section 60 causes the sheet conveyed by the conveying section 23 to contact the intermediate transfer belt 50, so that the toner image formed on the outer surface of the intermediate transfer belt 50 is transferred to the sheet. The secondary transfer section 60 has a secondary transfer belt 67 and a cleaning blade 65 adapted to remove the toner adhering on the secondary transfer belt 67. The secondary transfer section 60 will be described later in more detail.

The fixing section 80 is arranged on the sheet ejection side of the secondary transfer section 60. The fixing section 80 presses and heats the sheet to fix the transferred toner image to the sheet. The fixing section 80 is configured by, for example, a pair of fixing members which are an upper fixing roller 81 and a lower fixing roller 82. The upper fixing roller 81 and the lower fixing roller 82 are arranged in a state where they are brought into pressure contact with each other, so that a fixing nip is formed as a pressure-contact portion between the upper fixing roller 81 and the lower fixing roller 82.

A heater is provided within the upper fixing roller 81. A roller portion of the upper fixing roller 81 is heated by the heat radiated from the heater. The heat of the roller portion of the upper fixing roller 81 is transferred to the sheet, and thereby the toner image on the sheet is heat-fixed.

The sheet is conveyed to pass through the fixing nip in a state where the surface having the toner image transferred thereto by the secondary transfer section 60 (i.e., the surface to be subjected to the fixing process) faces the upper fixing roller 81. Thus, when the sheet passing through the fixing nip is pressed by the upper fixing roller 81 and the lower fixing roller 82, it is heated by the roller portion of the upper fixing roller 81.

A switching gate 24 is arranged on the downstream side of the sheet conveying direction of the fixing section 80. The switching gate 24 switches the conveying path of the sheet having passed through the fixing section 80. In other words, when ejecting sheet with the image side facing up in the case of performing one-sided image formation, the switching gate 24 will cause the sheet to go straight ahead. Therefore, the sheet is ejected by a pair of sheet ejecting rollers 25. Further, when ejecting the sheet with the image side facing down in the case of performing one-sided image formation, or when performing two-sided image formation, the switching gate 24 will guide the sheet downward.

Further, when ejecting sheet with the image side facing down, the sheet is guided downward by the switching gate 24 and then reversed and conveyed upward by a sheet reversing and conveying section 26. Therefore, the reversed sheet is ejected by the pair of sheet ejecting rollers 25.

When performing two-sided image formation, the sheet is guided downward by the switching gate 24 and then reversed by the sheet reversing and conveying section 26 and sent to the transfer position again by a sheet re-feeding path 27.

Alternatively, a post-processing device may be arranged on the downstream side of the pair of the sheet ejecting rollers 25, wherein the post-processing device is adapted to perform folding processing, stapling processing and/or the like on the sheet.

[Secondary Transfer Section]

Next, the secondary transfer section 60 will be described below with reference to FIG. 2.

Figure 2:
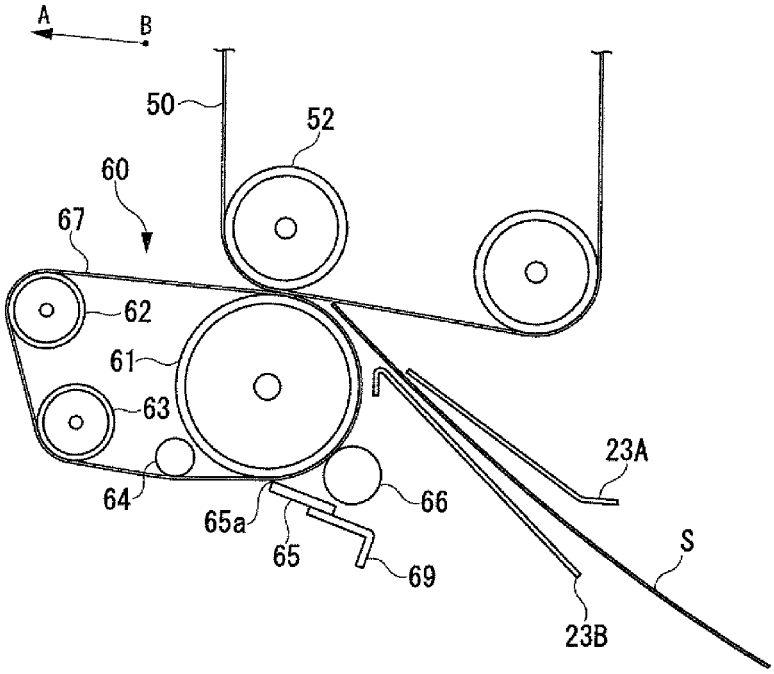
FIG. 2 is a view showing a secondary transfer section of the image forming apparatus.

FIG. 2 is a view showing the secondary transfer section 60. Note that, in FIG. 2, the sheet to be conveyed by the secondary transfer belt 67 is donated by letter "S", and the sheet conveying direction is indicated by arrow "A". Further, in a plane parallel to the surface of the secondary transfer belt 67, the direction perpendicular to the sheet conveying direction is donated by letter "B".

Figure 3:
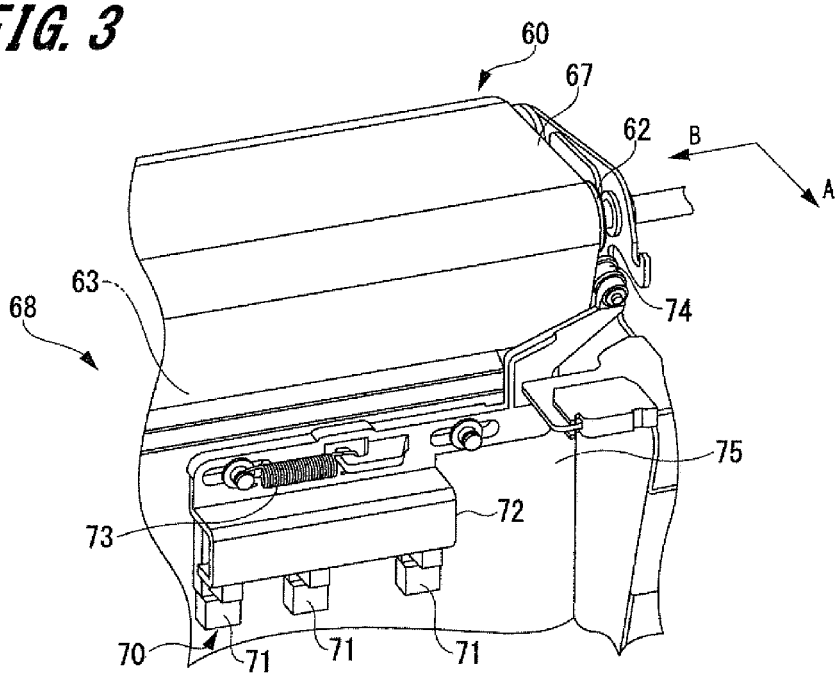
FIG. 3 is a perspective view showing a steering mechanism of the image forming apparatus.

As shown in FIG. 2, the secondary transfer section 60 includes a secondary transfer roller 61, a secondary transfer roller 61, a drive roller 62, a steering roller 63, a driven roller 64, the cleaning blade 65, a lubricant brush 66, the secondary transfer belt 67 (as an example of the belt of the present invention), and a steering mechanism 68 (see FIG. 3).

The secondary transfer roller 61 is brought into pressure contact with a secondary transfer counter roller 52 through the secondary transfer belt 67 and the intermediate transfer belt 50. The nip portion where the secondary transfer roller and the intermediate transfer belt 50 come into contact with each other is the transfer position where the toner image formed on the outer surface of the intermediate transfer belt 50 is transferred to the sheet S.

The secondary transfer belt 67 is wrapped around the secondary transfer roller 61, the drive roller 62, the steering roller 63 and the driven roller 64, and is adapted to be able to rotate either in a first rotating direction in which the sheet is caused to be conveyed along the conveying direction A or in a second rotating direction opposite to the first rotating direction.

Figure 4:
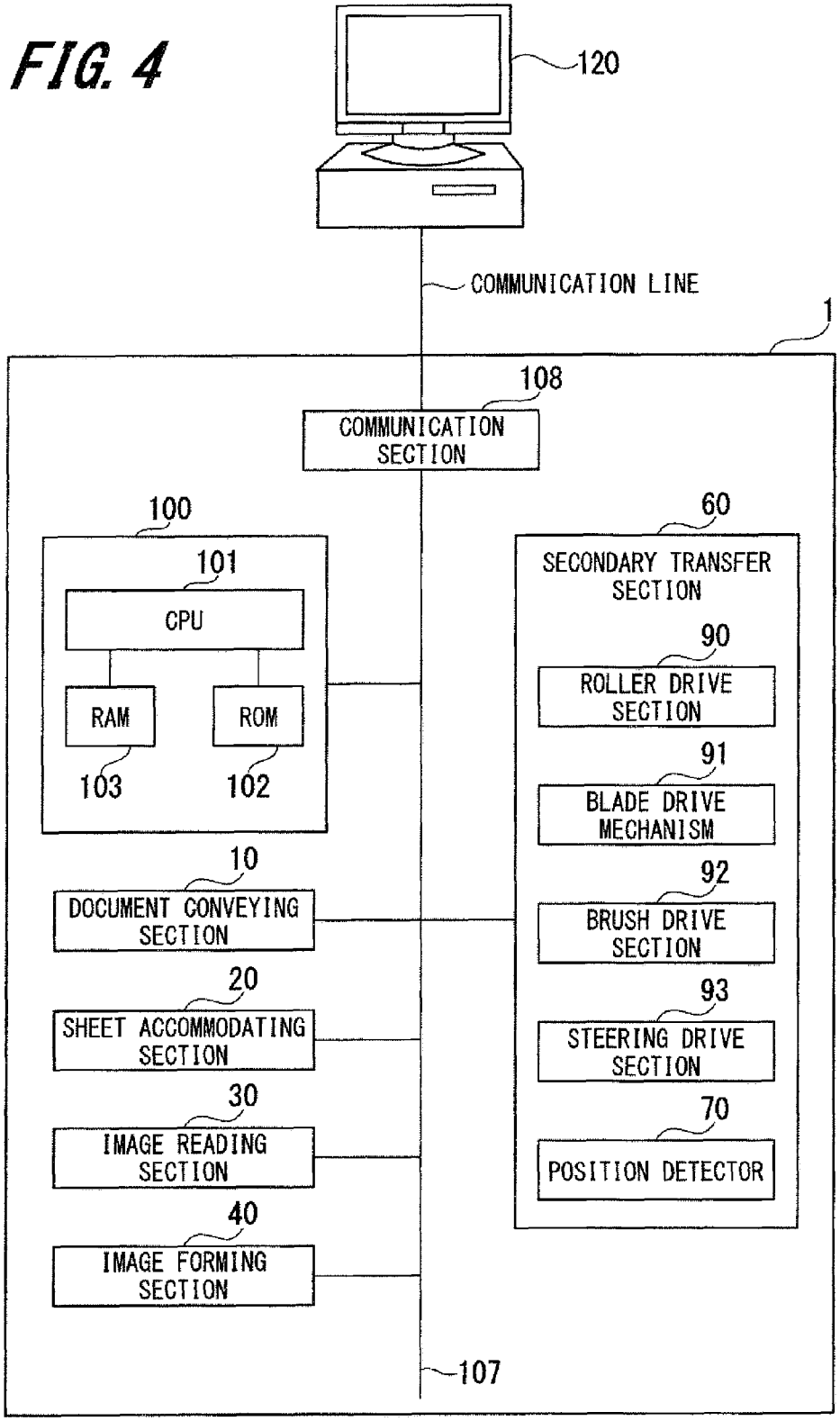
FIG. 4 is a block diagram showing a control system of the image forming apparatus.

The drive roller 62 is rotated by a roller drive section (see FIG. 4). In the present embodiment, a stepping motor is used as the driving source of the roller drive section 90. The driving force generated by the rotation of the drive roller 62 is transmitted to the secondary transfer roller 61, the steering roller 63 and the driven roller 64 through the secondary transfer belt 67. Thus, the secondary transfer roller 61, the steering roller 63 and the driven roller 64 rotate along with the drive roller 62. Due to being driven by the drive roller 62, the secondary transfer belt 67 rotates to convey the sheet which has guided to the transfer position by guide members 23A, 23B of the conveying section 23.

The secondary transfer belt 67 is an example of the belt of the present invention. The secondary transfer belt 67 has toner adhered thereto for forming a pattern to adjust color registration or forming a cleaning pattern. When forming images on both sides of the sheet, since one side (front surface) of the sheet on which an image has been first formed contacts the secondary transfer belt 67, there is a possibility that the toner of the image formed on the one side of the sheet might adhere to the secondary transfer belt 67. Also, when forming an image over the entire area of the sheet (i.e., when performing a so-called "full bleed printing"), there is a possibility that the toner might adhere to the secondary transfer belt 67. The toner adhering to the secondary transfer belt 67 is removed by the cleaning blade 65.

The cleaning blade 65 is a substantially rectangular plate-like member formed of an elastic material such as a rubber, a resin or the like. The cleaning blade 65 has two long side portions opposite to each other in the transversal direction and two short side portions opposite to each other in the longitudinal direction.

One long side portion forms an abutting portion 65*a* that abuts the surface of the secondary transfer belt 67. The secondary transfer belt 67 rotates in a state where the abutting portion 65*a* abuts the secondary transfer belt 67, so that the toner adhering on the surface of the secondary transfer belt 67 is removed by the abutting portion 65*a*.

The other long side portion is fixed to a blade fixing portion 69. The drive roller 69 is fixed to a blade drive mechanism 91 (see FIG. 4). In the present embodiment, a stepping motor is used as the driving source of the blade drive mechanism 91. According to the instruction of the controller 100 (see FIG. 4), the blade drive mechanism 91 drives the cleaning blade 65 so that the cleaning blade 65 is moved close to or away from the secondary transfer belt 67.

The lubricant brush 66 has a rotating shaft extending in the same direction as the rotating shafts of the rollers 61, 62, 63, 64, and faces the secondary transfer roller 61 through the secondary transfer belt 67. The lubricant brush 66 is connected to a brush drive section 92 (see FIG. 4). In the present embodiment, a stepping motor is used as the driving source of the brush drive section 92. According to the instruction of the controller 100 (see FIG. 4), the brush drive section 92 drives the lubricant brush 66 to rotate. The lubricant brush 66 is sliding-contacted with a lubricant block (not shown) formed of a solid lubricant to scrape off the lubricant, so that the scraped lubricant adheres to the surface of the brush. Further, the lubricant brush 66 contacts the secondary transfer belt 67, so that the lubricant adhering to the lubricant brush 66 is coated on the secondary transfer belt 67.

[Steering Mechanism]

Next, the steering mechanism 68 will be described below with reference to FIGS. 2 and 3. FIG. 3 is a perspective view of the steering mechanism 68. Note that, in FIG. 3, the conveying direction in which the secondary transfer belt 67 conveys the sheet is indicated by arrow "A", and in a plane parallel to the surface of the secondary transfer belt 67, the direction perpendicular to the sheet conveying direction is donated by letter "B".

When rotating, the secondary transfer belt 67 is predisposed to deviate to either side in the width direction of the secondary transfer belt 67 depending on the assembly attitude of the rollers 61, 62, 63, 64, the distortion of the secondary transfer section 60 itself, and/or the like. Such a predisposition causes color drift of the toner image transferred to the sheet. To solve such a problem, the image forming apparatus 1 of the present embodiment is provided with the steering mechanism 68 adapted to periodically read the position of the secondary transfer belt 67 in the width direction and correct the deviation or meandering of the secondary transfer belt 67. Incidentally, the width direction of the secondary transfer belt 67 is identical to the direction B.

The steering mechanism 68 of the present embodiment includes the steering roller 63, a position detector 70 (see FIG. 3), and a steering drive section 93 (see FIG. 4).

One end portion of the steering roller 63 in the direction B is connected to the steering drive section 93. In the present embodiment, a stepping motor is used as the driving source of the steering drive section 93. According to the instruction of the controller 100 (see FIG. 4), the steering drive section 93 tilts the other end portion of the steering roller 63 in the direction B.

The position detector 70 includes three photosensors 71, a movable portion 72, and a biasing member 73.

The movable portion 72 has a roller portion 74 which contacts a side portion of the secondary transfer belt 67 in the direction B (note that sometimes the "side portion of the secondary transfer belt 67 in the direction B" is simply referred to as "side portion" hereinafter). The movable portion 72 is supported by a supporting member 75 provided in the image forming apparatus 1 so that it can move in the direction B. The roller portion 74 rotates with the rotation of the secondary transfer belt 67.

The biasing member 73 is a spring-like member with one end portion thereof connected to the movable portion 72 and the other end portion thereof connected to the supporting member 75. The biasing member 73 biases the movable portion 72 so that the roller portion 74 contacts the side portion of the secondary transfer belt 67 in the direction B.

Each photosensor 71 is a reflective photosensor having a light-emitting portion (not shown) and a light-receiving portion (not shown), wherein the light-emitting portion is adapted to emit light and the light-receiving portion is adapted to receive light. A reflecting (not shown) is provided at a predetermined place located in the lower portion of the movable portion 72. When receiving light, the light-receiving portion outputs a detection signal to the controller 100 (see FIG. 4).

[Configuration of Control System of Image Forming Apparatus]

A control system of the image forming apparatus 1 will be described below with reference to FIG. 4.

FIG. 4 is a block diagram of the control system of the image forming apparatus 1.

As shown in FIG. 4, the image forming apparatus 1 includes the controller 100. The controller 100 is connected to a communication section 108, the document conveying section 10, the sheet accommodating section 20, the image reading section 30, the image forming section 40 and the secondary transfer section 60 through a system bus 107.

The controller 100 controls the operation (driving) of the document conveying section 10, the sheet accommodating section 20, the image reading section 30, the image forming section 40 and the secondary transfer section 60 connected thereto. In other words, the controller 100 controls the entire image forming apparatus 1. The controller 100 includes a CPU (central processing unit) 101, a ROM (Read Only Memory) 102 for storing program(s) executed by the CPU 101 and the like, and a RAM (Random Access Memory) 103 used as work area of the CPU 101. Incidentally, a programmable ROM capable of erasing the data electrically stored therein, for example, is used as the ROM 102.

The communication section 108 is adapted to receive, through a communication line, job information sent from a PC (personal computer) 120, which is the aforesaid external device. The received job information is transmitted to the controller 100 through the system bus 107.

Incidentally, although the present embodiment is described based on an example in which a personal computer is used as the external device, the present invention is not limited to such example, but various other devices, such as a facsimile device or the like, can be used as the external device.

During the rotation of the secondary transfer belt 67, the controller 100 performs steering control every predetermined timing.

Figure 5:
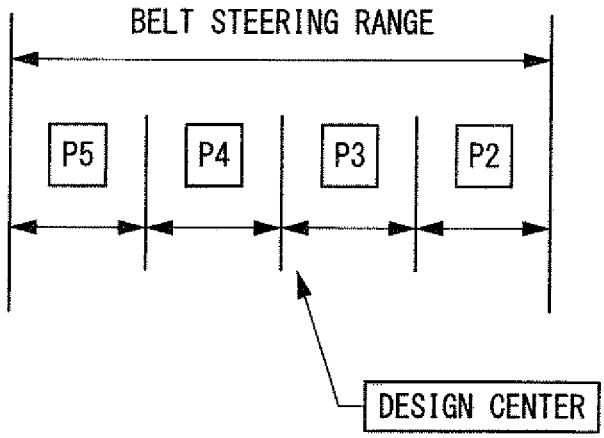
FIG. 5 is a view for explaining the position of a side portion of a secondary transfer belt detected when performing steering control.

The steering control will be described below with reference to FIG. 5. FIG. 5 is a view for explaining the position of the side portion of secondary transfer belt 67 detected when performing the steering control. When performing the steering control, the controller 100 detects the position of the secondary transfer belt 67 based on the detection signal outputted from the photosensors 71 of the position detector 70. For example, the controller 100 detects, based on the detection signal, whether or not the side portion of the secondary transfer belt in the direction B is located at any one of predetermined positions P2 to P5 as shown in FIG. 5.

Next, based on the detected position of the secondary transfer belt 67, the controller 100 controls the operation of the steering drive section 93 to tilt the steering roller 63 to correct the deviation or meandering of the secondary transfer belt 67. For example, the controller 100 controls the operation of the steering drive section 93 to tilt the steering roller 63 so that the side portion of the secondary transfer belt 67 is located at either the position P3 or the position P4.

To be specific, the controller 100 controls the operation of the steering drive section 93 so that when the side portion of the secondary transfer belt 67 is located at the position P3 , the side portion of the secondary transfer belt 67 will be moved to the position P4; and when the side portion of the secondary transfer belt 67 is located at the position P4, the side portion of the secondary transfer belt 67 will be moved to the position P3. Further, the controller 100 controls the operation of the steering drive section 93 so that when the side portion of the secondary transfer belt 67 is located at the position P5, the side portion of the secondary transfer belt 67 will be moved to the position P4; and when the side portion of the secondary transfer belt 67 is located at the position P2, the side portion of the secondary transfer belt 67 will be moved to the position P3.

Thus, the side portion of the secondary transfer belt 67 can be situated close to a design ideal position (i.e., a design center) which is the boundary between the position P3 and the position P4.

Further, the controller 100 clocks the time necessary for the steering control, i.e., the time necessary to perform one position transition (note that sometimes such time is referred to as "belt position transition time" hereinafter) every time it performs the steering control, and stores the result in the ROM 102 or RAM 103.

Further, the controller 100 conducts a blade abutting stabilization control. The blade abutting stabilization control is a control for stabilizing the abutting state between the secondary transfer belt 67 and the cleaning blade 65. The controller 100 determines whether or not it is necessary to conduct the blade abutting stabilization control based on the belt position transition time.

Here, the relationship between the belt position transition time and the abutting state between the secondary transfer belt 67 and the cleaning blade 65 is described below with reference to FIG. 6.

Figure 6:
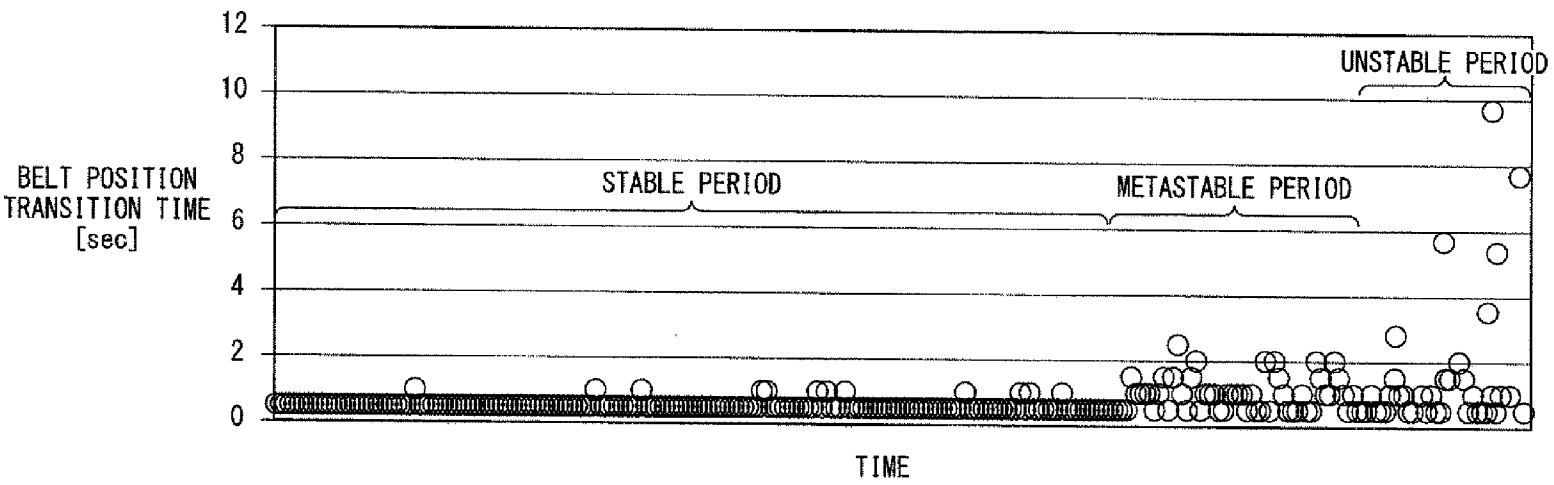
FIG. 6 is a scatter plot showing the relationship between operation time of the image forming apparatus and belt position transition time.

FIG. 6 is a scatter plot showing the relationship between operation time of the image forming apparatus 1 and belt position transition time.

The term "stable period" indicated in FIG. 6 is a period in which the friction between the cleaning blade 65 and the secondary transfer belt 67 is relatively small, and therefore the abutting state between the cleaning blade 65 and the secondary transfer belt 67 is stable. In the stable period, variation in belt position transition time is small. Further, in the stable period, good cleaning effect caused by the cleaning blade 65 can be expected.

The term "stable period" indicated in FIG. 6 is a period in which the friction between a portion of the cleaning blade 65 and the secondary transfer belt 67 is larger compared with the stable period, and therefore the abutting state between the cleaning blade 65 and the secondary transfer belt 67 is slightly unstable.

For example, if the friction between a portion of the cleaning blade 65 in the direction B and the secondary transfer belt 67 becomes large, such portion of the cleaning blade 65 will slightly bound on the surface of the secondary transfer belt 67 to cause so-called "bounding".

Thus, pressing force for the cleaning blade 65 to press the secondary transfer belt 67 differs between the portion of the cleaning blade 65 where the bounding occurs and the other portion of the cleaning blade 65. Thus, a difference in belt tension is caused between a portion of the secondary transfer belt 67 which abuts the portion of the cleaning blade 65 where the bounding occurs and the other portion of secondary transfer belt 67 which abuts the other portion of the cleaning blade 65. Thus, since the transition of the belt position can not be smoothly performed, the belt position transition time may be longer compared with the stable period.

Thus, a variation in belt position transition time ranging from 0.5 to 3 seconds is observed in the metastable period. However, in the metastable period, the cleaning effect of the cleaning blade 65 does not drop to a level that may cause cleaning failure.

The term "unstable period" indicated in FIG. 6 is a period in which the friction between almost the entire cleaning blade 65 and the secondary transfer belt 67 is larger compared with the metastable period, and the bounding of the cleaning blade 65 becomes deteriorated, so that the abutting state between the cleaning blade 65 and the secondary transfer belt 67 is unstable.

In the unstable period, the difference in belt tension becomes large with the deterioration of the bounding of the cleaning blade 65. Thus, in the unstable period, the belt position transition time may become further longer compared with the metastable period.

Thus, a variation in belt position transition time ranging from 0.5 to 9 seconds is observed in the unstable period. Further, in the unstable period, the cleaning effect of the cleaning blade 65 is not sufficient, and cleaning failure occurs.

To solve such problem, in the metastable period, which is a period before the unstable period, the controller 100 determines that it is necessary to perform the blade abutting stabilization control, and performs the blade abutting stabilization control. To be specific, the controller 100 calculates standard deviation and $3\sigma$ based on the belt position transition time stored in the ROM 102 or the RAM 103, and determines, if the last stored belt position transition time falls within the range of $3\sigma$, that it is necessary to perform the blade abutting stabilization control.

Incidentally, if it is intended to increase the number of data stored in the ROM 102 or the RAM 103 so as to increase the accuracy of the determination, a predetermined number of data (for example, 200 pieces of pseudo belt position transition time) may be stored in the ROM 102 or the RAM 103. Further, the determination of whether or not it is necessary to perform the blade abutting stabilization control may also be executed when the number of data of the belt position transition time stored exceeds the predetermined number of data.

Figure 7:
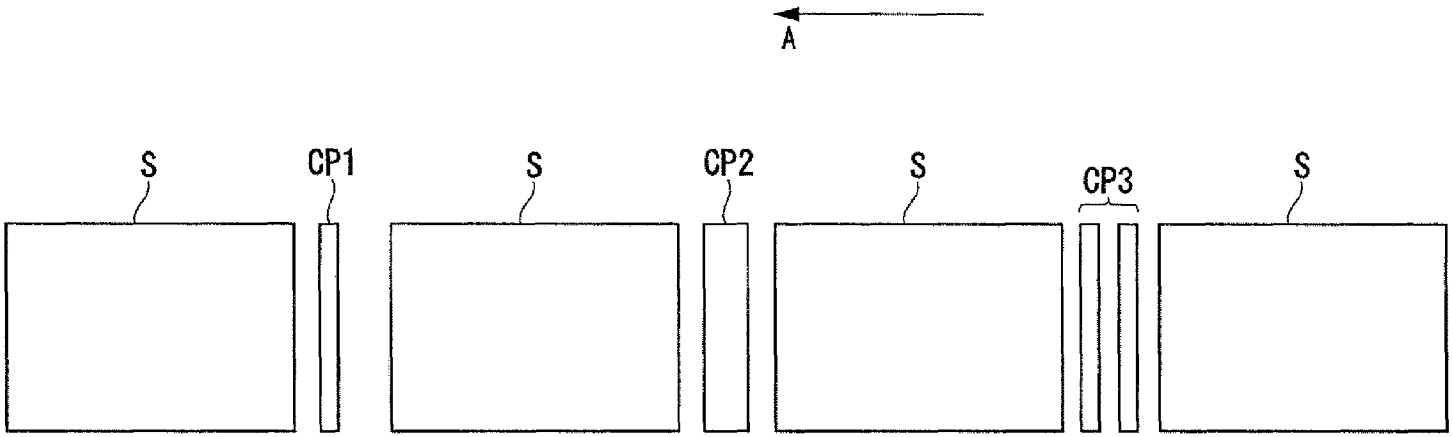
FIG. 7 is a view showing cleaning belts formed on the secondary transfer belt when performing blade abutting stabilization control.

Next, the blade abutting stabilization control performed by the controller 100 will be described below with reference to FIG. 7. FIG. 7 is a view showing cleaning belts formed on the secondary transfer belt 67 when performing the blade abutting stabilization control. In FIG. 7, the sheet is indicated by letter "S", and the conveying direction of the sheet conveyed to the secondary transfer belt 67 is indicated by arrow "A".

When performing the blade abutting stabilization control, the controller 100 controls the operation of the image forming section 40 to form a cleaning belt (i.e., a cleaning pattern) on the secondary transfer belt 67, wherein the cleaning belt has a predetermined shape.

The cleaning belt is a rectangular pattern formed for supplying an external additive (which has the same function as a lubricant) between the cleaning blade 65 and the secondary transfer belt 67, and is formed by a toner that contains the external additive. The cleaning belt is formed on the surface of the secondary transfer belt 67 after the image has been transferred to the sheet. In the case where the image is continuously formed, as shown in FIG. 7, the cleaning belt is formed between the sheets continuously conveyed.

In FIG. 7, the cleaning belt CP1 is a cleaning belt formed when the blade abutting stabilization control is not performed (i.e., in the normal time). The cleaning belt CP2 and cleaning belt CP3 are each a cleaning belt formed when the blade abutting stabilization control is performed. The cleaning belt CP2 is formed so that the area thereof is substantially twice as large as the area of the cleaning belt CP1. Further, the cleaning belt CP3 is formed as two cleaning belts CP1 aligned side by side. In other words, the toner amount necessary for forming the cleaning belt CP2 or the cleaning belt CP3 is larger than the toner amount necessary for forming the cleaning belt CP1 (which is a predetermined amount of toner). Thus, when performing the blade abutting stabilization control, the amount of the external additive supplied to between the cleaning blade 65 and the secondary transfer belt 67 is larger compared with the normal time.

When a large amount of the external additive is supplied to between the cleaning blade 65 and the secondary transfer belt 67, the friction between the cleaning blade 65 and the secondary transfer belt 67 is reduced. Thus, the abutting state between the cleaning blade 65 and the secondary transfer belt 67 can be adjusted, and therefore blade burr can be restrained, and occurrence of bounding can be suppressed.

Incidentally, when performing the blade abutting stabilization control, the controller 100 may also control the operation of the image forming section 40 to either form the cleaning belt CP2 only or form the cleaning belt CP3 only, instead of alternately forming the cleaning belt CP2 and the cleaning belt CP3.

Figure 8:
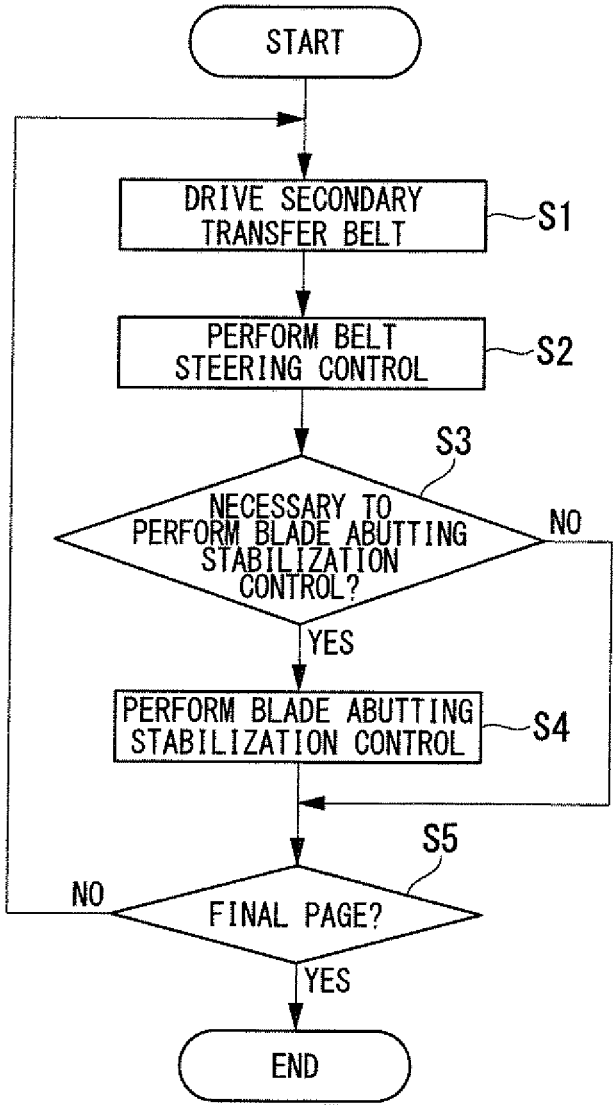
FIG. 8 is a flowchart showing the operation of the image forming apparatus when forming image.

The operation of the image forming apparatus 1 when forming image will be described below with reference to FIG. 8. FIG. 8 is a flowchart showing the operation of the image forming apparatus 1 when forming image.

First, when the communication section 108 receives job information, or when the user operates an operation unit (not shown) of the image forming apparatus 1, the controller 100 will control the operation of each section including the roller drive section 90 according to the job information or the user's operation to rotate the secondary transfer belt 67 (step S1).

Next, the controller 100 controls the operation of the steering drive section 93 to perform the belt steering control (step S2).

Next, the controller 100 determines whether or not it is necessary to perform the blade abutting stabilization control (step S3).

If it is determined that it is necessary to perform the blade abutting stabilization control (YES in step S3), the controller 100 will performs the blade abutting stabilization control (step S4). While if it is determined that it is not necessary to perform the blade abutting stabilization control (NO in step S3), the controller 100 will move the processing to step S5.

The controller 100 determines, based on the job information or the operation inputted to the operation unit, whether or not the image of the final page has been formed (step S5). If it is determined that the image of the final page has been formed, the controller 100 will terminate the operation executed when forming image; while if it is determined that the image of the final page has not been formed, the controller 100 will return the processing to step S1.

Here, occurrence of bounding can be considered as a sign of the blade burr. As described above, the belt position transition time varies according to occurrence of bounding. In the image forming apparatus 1 of the present embodiment, whether or not it is necessary to perform the blade abutting stabilization control is determined based on the belt position transition time. In other words, the blade abutting stabilization control (i.e., the formation of the cleaning belts CP2, CP3 in the present embodiment), which is a measure to prevent the blade burr, can be performed based on the sign of the blade burr. Thus, it is possible to perform the blade abutting stabilization control at appropriate time.

Described above is an embodiment to which the present invention is applied. It is to be understood that the present invention is not limited to the aforesaid embodiment, and various modifications can be made without departing from the spirit and scope of the present invention.

For example, the present invention includes a configuration in which a reference transition time previously calculated based on a simulation or an experiment is stored in the ROM 102, and the controller 100 compares the last clocked belt position transition time with the reference transition time to determine whether or not it is necessary to perform the blade abutting stabilization control. In such a case, if the clocked belt position transition time exceeds the reference transition time, the controller 100 will determine that it is necessary to perform the blade abutting stabilization control.

Further, instead of the image forming section 40, the blade drive mechanism 91 may be used as the adjuster. In such a case, when performing the blade abutting stabilization control, the controller 100 controls the operation of the blade drive mechanism 91 to move the cleaning blade 65 so that the value of the force for the cleaning blade 65 to press secondary transfer belt 67 is larger than that in the normal time (which is a predetermined value). Thus, it is possible to cause the cleaning blade 65 to press the secondary transfer belt 67 more strongly than the normal time to thereby suppress the occurrence of bounding and restrain the burr of the cleaning blade 65.

Further, the brush drive section 92 may also be used as the adjuster. In such case, when performing the blade abutting stabilization control, the controller 100 controls the operation of the brush drive section 92 to increase the lubricant coated onto the secondary transfer belt 67 compared with the normal time to thereby adjust the abutting state between the cleaning blade 65 and the secondary transfer belt 67. To be specific, when performing the blade abutting stabilization control, the controller 100 controls the operation of the brush drive section 92 so that the rotation number in a predetermined period becomes larger than that of the normal time. Thus, the coating amount of the lubricant is larger than the coating amount of the normal time (a predetermined amount), and therefore the friction between the cleaning blade 65 and the secondary transfer belt 67 is reduced. Thus, the abutting state between the cleaning blade 65 and the secondary transfer belt 67 can be adjusted, and therefore occurrence of bounding can be suppressed, and blade burr can be restrained.

Further, the roller drive section 90 may also be used as the adjuster. In such case, when performing the blade abutting stabilization control, the controller 100 controls the operation of the roller drive section 90 to rotate the secondary transfer belt 67 in a direction opposite to the direction when forming the image on the sheet. By rotating the secondary transfer belt 67 in opposite direction, the cleaning blade 65 caused due to the normal rotation of the secondary transfer belt 67 can be restored to its original shape. Thus, the abutting state between the cleaning blade 65 and the secondary transfer belt 67 is adjusted, and thereby the subsequent occurrence of bounding and blade burr can be suppressed.

Further, although the present embodiment is described based on an example in which the present invention is applied to the secondary transfer section 60, the present invention may also be applied to the intermediate transfer belt 50, the conveying belt for conveying the sheet, and/or the like.

What is claimed is:

1. An image forming apparatus comprising:

an endless belt;

a steering mechanism adapted to correct deviation of the belt;

a cleaning blade adapted to abut the belt so as to clean the belt;

a timer adapted to clock the time necessary for the steering mechanism to correct the deviation of the belt;

an adjuster adapted to adjust the abutting state between the belt and the cleaning blade; and a controller adapted to control the operation of the adjuster based on the time clocked by the timer.

2. The image forming apparatus according to claim 1, wherein the controller causes the adjuster to operate if the time clocked by the timer is longer than a predetermined time.

3. The image forming apparatus according to claim 1, further comprising:

a storage adapted to store the time clocked by the timer, wherein the controller causes the adjuster to operate if variation in the time clocked by the timer is equal to or larger than a predetermined value.

4. The image forming apparatus according to claim 1, wherein the adjuster is an image forming section, and is adapted to adjust the abutting state between the belt and the cleaning blade by making the amount of toner supplied to the belt larger than a predetermined amount.

5. The image forming apparatus according to claim 1, wherein the adjuster is a pressing force adjusting mechanism to adjust the force for the cleaning blade to press the belt, and is adapted to adjust the abutting state between the belt and the cleaning blade by making the force for the cleaning blade to press the belt larger than a predetermined value.

6. The image forming apparatus according to claim 1, wherein the adjuster is a coating unit drive section to drive a lubricant coating unit for coating a lubricant onto the belt, and is adapted to adjust the abutting state between the belt and the cleaning blade by making the coating amount of the lubricant larger than a predetermined amount.

7. The image forming apparatus according to claim 1, further comprising:

a drive roller that contacts the belt so as to rotationally drive the belt, wherein the adjuster is a roller drive section to drive the drive roller, and is adapted to adjust the abutting state between the belt and the cleaning blade by rotationally driving the belt in a direction opposite to the direction when forming the image onto the sheet.

* * * * *